US009529297B2

(12) United States Patent
Okamoto et al.

(10) Patent No.: US 9,529,297 B2
(45) Date of Patent: Dec. 27, 2016

(54) DEVELOPING DEVICE, PROCESS CARTRIDGE, AND IMAGE FORMING APPARATUS INCLUDING SAME

(71) Applicants: Hiroaki Okamoto, Kanagawa (JP); Tadashi Ogawa, Tokyo (JP); Hiroyuki Mabuchi, Kanagawa (JP); Yukio Otome, Ibaraki (JP); Junichi Terai, Kanagawa (JP); Hideki Kimura, Kanagawa (JP); Hiroshi Kikuchi, Kanagawa (JP)

(72) Inventors: Hiroaki Okamoto, Kanagawa (JP); Tadashi Ogawa, Tokyo (JP); Hiroyuki Mabuchi, Kanagawa (JP); Yukio Otome, Ibaraki (JP); Junichi Terai, Kanagawa (JP); Hideki Kimura, Kanagawa (JP); Hiroshi Kikuchi, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 14/982,016

(22) Filed: Dec. 29, 2015

(65) Prior Publication Data

US 2016/0202630 A1 Jul. 14, 2016

(30) Foreign Application Priority Data

Jan. 9, 2015 (JP) ..... 2015-003334
Oct. 30, 2015 (JP) ..... 2015-213595

(51) Int. Cl.
*G03G 15/08* (2006.01)

(52) U.S. Cl.
CPC ..... *G03G 15/0808* (2013.01); *G03G 15/0806* (2013.01); *G03G 2215/0648* (2013.01)

(58) Field of Classification Search
None
See application file for complete search history.

(56) References Cited

U.S. PATENT DOCUMENTS 6,393,247 B1 * 5/2002 Chen ..... G03G 15/2053 399/330
7,466,946 B2 12/2008 Tsujita et al.
(Continued)

FOREIGN PATENT DOCUMENTS

JP 11-143191 5/1999
JP 2003-255692 9/2003
(Continued)

OTHER PUBLICATIONS

JP 2011022451 English machine translation, Otome, Feb. 2011.*
Extended European Search Report issued on Jun. 3, 2016 in European Patent Application No. 15202804.9.

*Primary Examiner* — David Gray
*Assistant Examiner* — Thomas Giampaolo, II
(74) *Attorney, Agent, or Firm* — Oblon, McClelland, Maier & Neustadt, L.L.P.

(57) ABSTRACT

A developing device to develop a latent image on a rotatable image bearer includes an upstream developing roller disposed opposite the image bearer at a first developing position, and a downstream developing roller disposed adjacent to and downstream from the upstream developing roller in a direction of rotation of the image bearer, disposed opposite the image bearer at a second developing position. Each of the upstream developing roller and the downstream developing roller has a most approachable surface that approaches closest to the image bearer and a most withdrawn surface that withdraws farthest from the image bearer. In a state in which a reference surface point of the image bearer is disposed opposite the most approachable surface of the upstream developing roller at the first developing position,
(Continued)

the reference surface point opposes the most withdrawn surface of the downstream developing roller at the second developing position.

12 Claims, 7 Drawing Sheets

(56) References Cited

U.S. PATENT DOCUMENTS

| | | | | |
|---|---|---|---|---|
| 2004/0105705 | A1* | 6/2004 | Hirobe | G03G 9/107 399/269 |
| 2005/0265740 | A1 | 12/2005 | Hamby et al. | |
| 2006/0216069 | A1 | 9/2006 | Tsujita et al. | |
| 2008/0317508 | A1 | 12/2008 | Terai et al. | |
| 2009/0080943 | A1 | 3/2009 | Kato et al. | |
| 2010/0215389 | A1* | 8/2010 | Imahori | G03G 15/065 399/55 |
| 2010/0247123 | A1* | 9/2010 | Honjoh | G03G 15/757 399/44 |
| 2011/0222871 | A1 | 9/2011 | Suzuki et al. | |
| 2011/0299892 | A1* | 12/2011 | Minegishi | G03G 15/065 399/269 |
| 2012/0051792 | A1 | 3/2012 | Matsumoto et al. | |
| 2012/0207492 | A1 | 8/2012 | Fujiwara et al. | |
| 2012/0219326 | A1 | 8/2012 | Koike et al. | |
| 2012/0230733 | A1 | 9/2012 | Kikuchi et al. | |
| 2013/0034368 | A1 | 2/2013 | Hattori et al. | |
| 2013/0045029 | A1 | 2/2013 | Kimura et al. | |
| 2013/0064570 | A1 | 3/2013 | Yamane et al. | |
| 2014/0016960 | A1 | 1/2014 | Miyoshi et al. | |
| 2014/0233984 | A1 | 8/2014 | Miyoshi et al. | |
| 2014/0294412 | A1 | 10/2014 | Tanaka et al. | |
| 2014/0341618 | A1 | 11/2014 | Otome et al. | |
| 2014/0376951 | A1 | 12/2014 | Ogawa et al. | |
| 2014/0376970 | A1 | 12/2014 | Kimura et al. | |
| 2015/0023700 | A1 | 1/2015 | Nakamoto et al. | |
| 2015/0147096 | A1 | 5/2015 | Hori et al. | |
| 2015/0234318 | A1 | 8/2015 | Takahashi et al. | |

FOREIGN PATENT DOCUMENTS

| | | | |
|---|---|---|---|
| JP | 2004-191835 | | 7/2004 |
| JP | 2006-017510 | | 1/2006 |
| JP | 2006-235328 | | 9/2006 |
| JP | 2007-102126 | A | 4/2007 |
| JP | 2008145774 | A * | 6/2008 |
| JP | 2011022451 | A * | 2/2011 |
| JP | 2012-042799 | | 3/2012 |

* cited by examiner

| RUNOUT AMOUNT (μm) | MARKING COLOR |
|---|---|
| 0-6 | BLACK |
| 7-12 | RED |
| 13-16 | BLUE |
| 17-20 | GREEN |

| FIRST DEVELOPING ROLLER | SECOND DEVELOPING ROLLER |
|---|---|
| BLACK | BLACK OR RED |
| RED | BLACK, RED, OR BLUE |
| BLUE | RED, BLUE, OR GREEN |
| GREEN | BLUE OR GREEN |

DEVELOPING DEVICE, PROCESS CARTRIDGE, AND IMAGE FORMING APPARATUS INCLUDING SAME

CROSS-REFERENCE TO RELATED APPLICATIONS

This patent application is based on and claims priority pursuant to 35 U.S.C. §119(a) to Japanese Patent Application Nos. 2015-003334 filed on Jan. 9, 2015, and 2015-213595 filed on Oct. 30, 2015, in the Japan Patent Office, the entire disclosure of each of which is hereby incorporated by reference herein.

BACKGROUND

Technical Field

Embodiments of the present invention generally relate to a developing device for use in an electrophotographic image forming apparatus such as a photocopier, a facsimile machine, a printer, or a multifunction peripheral (MFP) having at least two of copying, printing, facsimile transmission, plotting, and scanning capabilities, and the image forming apparatus and a process cartridge including the developing device.

Description of the Related Art

There are multistage developing devices that includes multiple developer bearers (e.g., developing rollers) arranged in the direction of rotation of an image bearer (e.g., a photoconductor drum) and disposed facing the image bearer.

For example, there are developing devices that employ two-component developer including toner and carrier (in which one or more additives may be included) and includes two developing rollers. A portion of developer contained in the developing device is supplied to a first developing roller on the upstream side in the direction of rotation of the photoconductor drum. A doctor blade (i.e., a developer regulator) regulates the amount of developer on the first developing roller. When the first developing roller rotates and the developer on the first developing roller reaches a position facing the photoconductor drum (i.e., a first developing range), the toner in the developer is electrostatically attracted to a latent image on the photoconductor drum. Then, the developer on the first developing roller is, partly or entirely, supplied to a second developing roller on the downstream side. When the second developing roller rotates and the developer on the second developing roller reaches a position facing the photoconductor drum (i.e., a second developing range different from the first developing range), the toner in the developer is electrostatically attracted to the latent image on the photoconductor drum.

Such multistage developing devices excel in developing capability and provide high-quality images since the multiple developing rollers extend the duration of the developing process.

SUMMARY

An embodiment of the present invention concerns a developing device to develop a latent image on a rotatable image bearer and including an upstream developing roller disposed opposite the image bearer at a first developing position and a downstream developing roller disposed adjacent to and downstream from the upstream developing roller in a direction of rotation of the image bearer. The upstream developing roller and the downstream developing roller are disposed opposite the image bearer a first developing position and at a second developing position, respectively. Each of the upstream developing roller and the downstream developing roller has a most approachable surface that approaches closest to the image bearer and a most withdrawn surface that withdraws farthest from the image bearer at the first and second developing positions.

In a state in which a reference surface point of the image bearer is disposed opposite the most approachable surface of the upstream developing roller at the first developing position, the reference surface point opposes the most withdrawn surface of the downstream developing roller at the second developing position.

In another embodiment, a developing device to develop a latent image on a rotatable image bearer includes an upstream developing roller disposed opposite the image bearer at a first developing position and a downstream developing roller disposed adjacent to and downstream from the upstream developing roller in a direction of rotation of the image bearer. The upstream developing roller and the downstream developing roller are disposed opposite the image bearer a first developing position and at a second developing position, respectively. Each of the upstream developing roller and the downstream developing roller has a most approachable surface that approaches closest to the image bearer and a most withdrawn surface that withdraws farthest from the image bearer at the first and second developing positions, respectively. In a state in which a reference surface point of the image bearer is disposed opposite the most withdrawn surface of the upstream developing roller at the first developing position, the reference surface point opposes the most approachable surface of the downstream developing roller at the second developing position.

In yet another embodiment, a removably installable process cartridge for an image forming apparatus includes the image bearer and the developing device described above.

In yet another embodiment, an image forming apparatus includes the image bearer and the developing device described above.

BRIEF DESCRIPTION OF THE SEVERAL VIEWS OF THE DRAWINGS

A more complete appreciation of the disclosure and many of the attendant advantages thereof will be readily obtained as the same becomes better understood by reference to the following detailed description when considered in connection with the accompanying drawings, wherein.

DETAILED DESCRIPTION

Figure 1:
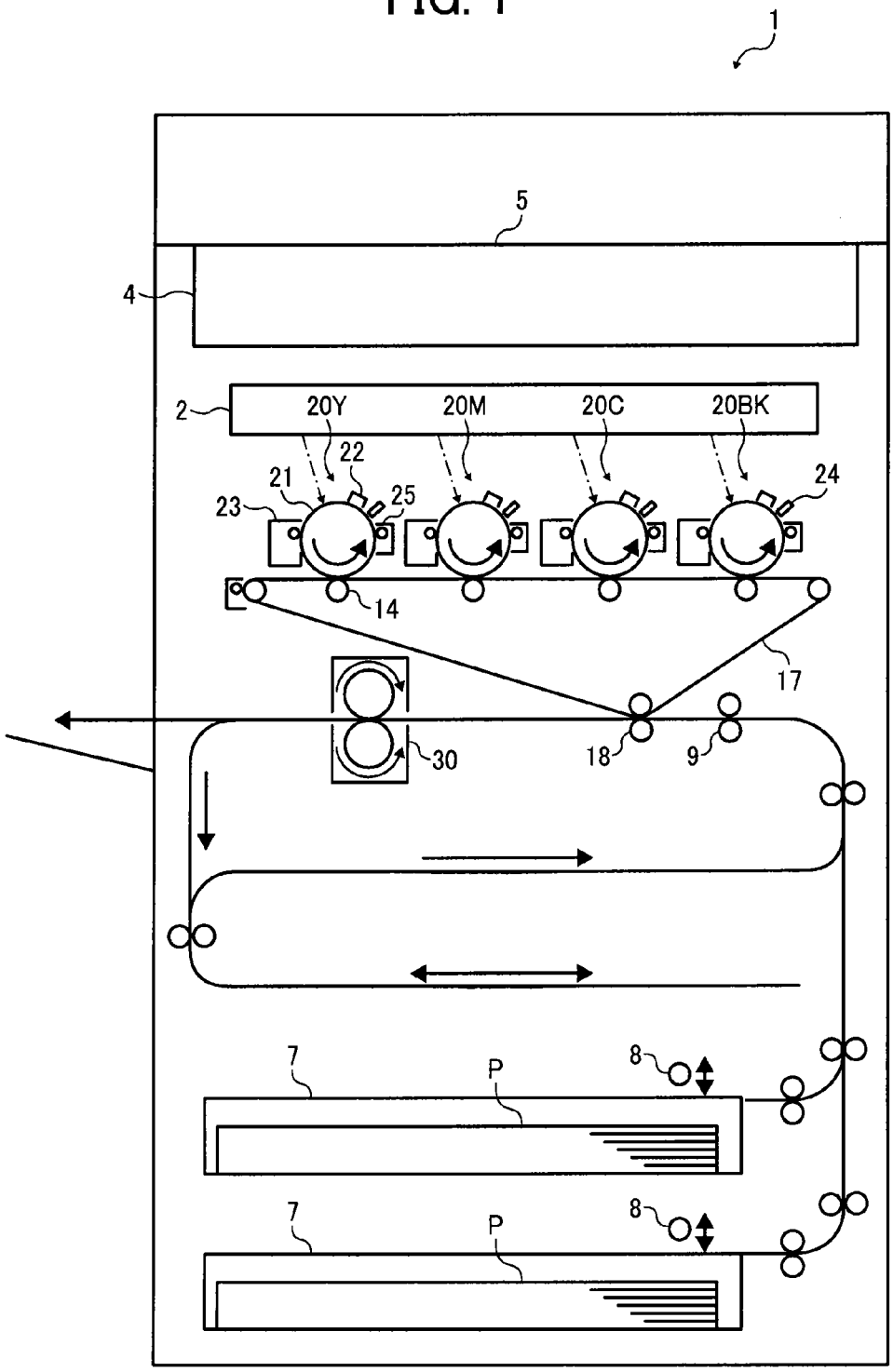
FIG. 1 is a schematic diagram illustrating a configuration of an image forming apparatus according to an embodiment.

In describing preferred embodiments illustrated in the drawings, specific terminology is employed for the sake of clarity. However, the disclosure of this patent specification is not intended to be limited to the specific terminology so selected, and it is to be understood that each specific element includes all technical equivalents that operate in a similar manner and achieve a similar result.

Referring now to the drawings, wherein like reference numerals designate identical or corresponding parts throughout the several views thereof, and particularly to FIG. 1, a multicolor image forming apparatus according to an embodiment of the present invention is described. Redundant descriptions are omitted or simplified below.

It is to be noted that the suffixes Y, M, C, and K attached to each reference numeral indicate only that components indicated thereby are used for forming yellow, magenta, cyan, and black images, respectively, and hereinafter may be omitted when color discrimination is not necessary.

Referring to FIG. 1, a configuration and operation of an image forming apparatus 1 according to an embodiment is described below.

In FIG. 1, reference numerals 2 represents a writing unit to emit laser beams according to image data, 4 represents a document reading unit 4 that reads image data of an document placed on an exposure glass 5, 7 represents a sheet feeding tray containing sheets P of recording media (e.g., transfer sheets), 9 represents a registration roller pair (timing roller pair) to adjust the timing to transport the sheet P, 14 represents a primary-transfer bias roller to transfer a toner image from a photoconductor drum 21 onto an intermediate transfer belt 17, onto which multiple single-color toner images are transferred and superimposed, 18 represents a secondary-transfer bias roller to transfer the multiple single-color toner images from the intermediate transfer belt 17 to the sheet P, 20Y, 20M, 20C, and 20BK represent process cartridges (image forming units) corresponding to the respective colors, 22 represents a charging device to charge a surface of the photoconductor drum 21, 23 represents a developing device to develop electrostatic latent images on the photoconductor drum 21, 24 represents a discharger to remove a surface potential of the photoconductor drum 21, 25 represents a cleaning device to collect residual toner (untransferred toner) from the surface of the photoconductor drum 21, and 30 represents a fixing device to fix the toner image on the sheet P.

Additionally, a developer supply unit is disposed above each of the process cartridges 20Y, 20C, 20M, and 20BK. The developer supply unit includes a developer container 28 (illustrated in FIG. 2) containing yellow, cyan, magenta, or black developers supplied to the developing device 23 and a developer supply device 80. In the present embodiment, two-component developer including toner and carrier is used.

Operations of the image forming apparatus 1 illustrated in FIG. 1 to form multicolor images are described below. It is to be noted that FIG. 2 is also referred to when image forming process performed by the process cartridges 20 are described.

The document reading unit 4 reads image data of the document set on the exposure glass 5 optically. More specifically, the document reading unit 4 scans the image on the document on the exposure glass 5 with light emitted from an illumination lamp. The light reflected from the surface of the document is imaged on a color sensor via mirrors and lenses. Multicolor image data of the document is decomposed into red, green, and blue (RGB), read by the color sensor, and converted into electrical image signals. Further, an image processor performs image processing (e.g., color conversion, color calibration, and spatial frequency adjustment) according to the image signals, and thus image data of yellow, magenta, cyan, and black are obtained.

Then, the yellow, magenta, cyan, and black image data is transmitted to the writing unit 2 (i.e., an exposure device). The writing unit 2 directs laser beams L (illustrated in FIG. 2) to the surfaces of the photoconductor drums 21 according to image data of respective colors.

Figure 2:
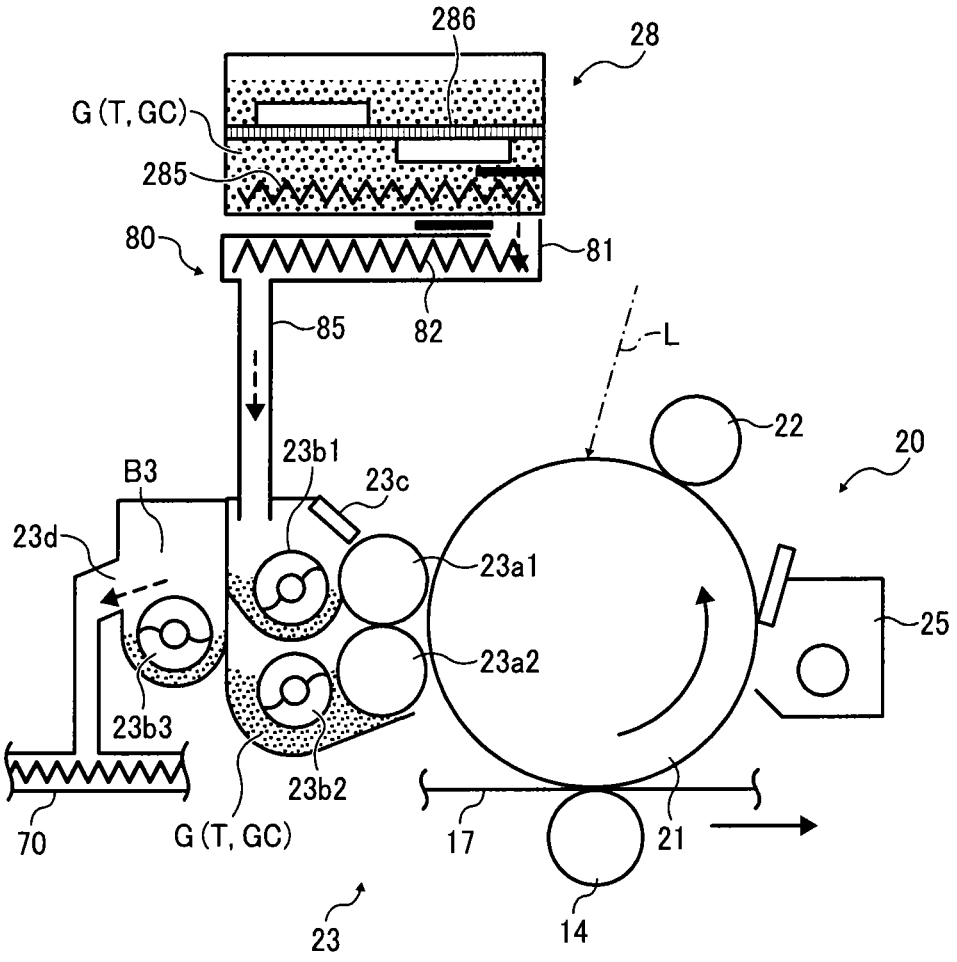
FIG. 2 is a schematic diagram illustrating an image forming unit included in the image forming apparatus illustrated in FIG. 1.

Meanwhile, the four photoconductor drums 21 rotate counterclockwise in FIGS. 1 and 2. Initially, the surface of the photoconductor drum 21 is charged by the charging device 22 (e.g., a charging roller) uniformly at a position facing the charging device 22 (charging process). The surface of the photoconductor drum 21 is charged to a predetermined electrical potential. Subsequently, the surface of the photoconductor drum 21 thus charged reaches a position to receive the laser beam L.

The writing unit 2 emits the laser beams L according to image data from four light sources. The four laser beams L pass through different optical paths for yellow, magenta, cyan, and black.

The laser beam L corresponding to the yellow component is directed to the photoconductor drum 21 in the process cartridge 20Y, which is the first from the left in FIG. 1 among the four process cartridges 20. A polygon mirror that rotates at high velocity deflects the laser beam L for yellow in a direction of a rotation axis of the photoconductor drum 21 (main scanning direction or longitudinal direction) so that the laser beam L scans the surface of the photoconductor drum 21. Thus, an electrostatic latent image for yellow is formed on the photoconductor drum 21 charged by the charging device 22.

Similarly, the laser beam L corresponding to the magenta component is directed to the photoconductor drum 21 in the process cartridge 20M, which is the second from the left in FIG. 1, thus forming an electrostatic latent image for magenta thereon. The laser beam L corresponding to the cyan component is directed to the photoconductor drum 21 of the process cartridge 20C, which is the third from the left in FIG. 1, thus forming an electrostatic latent image for cyan thereon. The laser beam L corresponding to the black component is directed to the photoconductor drum 21 of the process cartridge 20BK, which is the fourth from the left in FIG. 1, thus forming an electrostatic latent image for black thereon.

Then, each photoconductor drum 21 reaches a position facing the developing device 23, and the developing device 23 supplies toner of the corresponding color to the photoconductor drum 21. Thus, the latent images on the respective photoconductor drums 21 are developed into different single-color toner images (i.e., development process).

Subsequently, the surface of the photoconductor drum 21 reaches a position facing the intermediate transfer belt 17, serving as the image bearer as well as an intermediate transfer member. The primary transfer rollers 14 are disposed at the positions where the respective photoconductor drums 21 face the intermediate transfer belt 17 and in contact with an inner circumferential surface of the intermediate transfer belt 17. At these positions, the toner images on the respective photoconductor drums 21 are sequentially transferred and superimposed one on another on the intermediate transfer belt 17, forming a multicolor toner image thereon, in a primary transfer process.

After the primary transfer process, the surface of each photoconductor drum 21 reaches a position facing the cleaning device 25, where the cleaning device 25 collects toner remaining on the photoconductor drum 21 in a cleaning process.

Additionally, the surface of each photoconductor drum 21 passes through the discharge device 24, and a sequence of image forming processes performed on each photoconductor drum 21 are completed.

Meanwhile, the surface of the intermediate transfer belt 17 carrying the superimposed toner image moves clockwise in the drawing and reaches the position facing the secondary-transfer bias roller 18. The secondary-transfer bias roller 18 transfers the multicolor toner image from the intermediate transfer belt 17 onto the sheet P (secondary transfer process).

Further, the surface of the intermediate transfer belt 17 reaches a position facing a belt cleaning device. The belt cleaning device collects untransferred toner remaining on the intermediate transfer belt 17, and thus a sequence of transfer processes performed on the intermediate transfer belt 17 is completed.

The sheet P is transported from one of the sheet feeding trays 7 via the registration roller pair 9, and the like, to the secondary transfer nip between the intermediate transfer belt 17 and the secondary-transfer bias roller 18.

More specifically, a sheet feeding roller 8 sends out the sheet P from the sheet feeding tray 7, and the sheet P is then guided by a sheet guide to the registration roller pair 9. The registration roller pair 9 forwards the sheet P to a secondary transfer nip, timed to coincide with the arrival of the multicolor toner image on the intermediate transfer belt 17.

Then, the sheet P carrying the multicolor image is transported to the fixing device 30. The fixing device 30 includes a fixing roller and a pressure roller pressing against each other. A heat source such as a heater is provided inside the fixing roller, and, in a nip therebetween, the multicolor image is fused and fixed on the sheet P (fixing process).

After the fixing process, paper ejection rollers discharge the sheet P as an output image outside the image forming apparatus 1. Thus, a sequence of image forming processes is completed.

The process cartridge 20 (the image forming unit), the developer container 28, and the developer supply device 80 are described below.

It is to be noted that the process cartridges 20Y, 20C, 20M, and 20BK are similar in configuration and the developer containers 28 and the developer supply devices 80 are similar in configuration among different colors, and thus the subscripts Y, C, M, and BK are omitted in FIG. 2 and descriptions below for simplicity.

Figure 3:
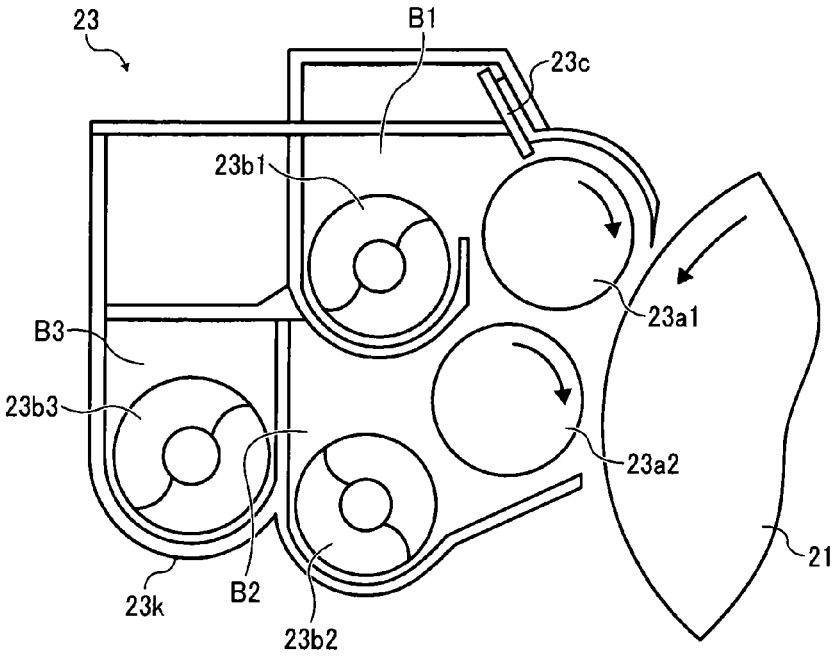
FIG. 3 is an enlarged view of a developing device according to an embodiment.

FIG. 2 is a schematic view of the process cartridge 20, the developer container 28, and the developer supply device 80 of the image forming apparatus 1. FIG. 3 is an enlarged view of the developing device 23 in the process cartridge 20.

As illustrated in FIG. 2, the process cartridge 20 includes the photoconductor drum 21, the charging device 22, the developing device 23, and the cleaning device 25, which are united together into a modular unit. The process cartridge 20 employs premix developing, in which supply and discharge of carrier is performed.

The photoconductor drum 21 (i.e., the image bearer) in the present embodiment is a negatively-charged organic photoconductor and is rotated counterclockwise in FIG. 2 by a driving unit.

The charging device 22 is an elastic charging roller including a metal core and an elastic layer overlying the metal core. In one embodiment, the elastic layer is made of foamed urethane adjusted to have a moderate resistivity with conductive particles such as carbon black, a sulfuration agent, a foaming agent, or the like. The material of the elastic layer of moderate resistivity include, but not limited to, rubber such as urethane, ethylene-propylene-diene-polyethlene (EPDM), acrylonitrile butadiene rubber (NBR), silicone rubber, and isoprene rubber to which a conductive material such as carbon black or a metal oxide is added to adjust the resistivity. Alternatively, foamed rubber including these materials may be used. Although the charging roller is used in the present embodiment, alternatively, a wire charger employing a corona discharge is used in another embodiment.

The cleaning device 25 includes a cleaning brush or a cleaning blade that slidingly contacts the surface of the photoconductor drum 21 and removes untransferred toner from the photoconductor drum 21 mechanically. The untransferred toner collected in the cleaning device 25 is transported with a conveyance coil outside the cleaning device 25 and collected in a waste toner container.

The developing device 23 includes first and second developing rollers 23*a*1 and 23*a*2 disposed close to the photoconductor drum 21 at a small distance (i.e., development gap) from the photoconductor drum 21. Areas where the first and second developing rollers 23*a*1 and 23*a*2 face the photoconductor drum 21 are referred to as first and second development positions, where magnetic brushes contact the photoconductor drum 21. The developing device 23 contains two-component developer G including toner T and carrier GC (in which one or more additives are also included). The developing device 23 develops the latent image on the photoconductor drum 21 into a toner image.

Specifically, a doctor blade 23*c* (i.e., a developer regulator) regulates the amount of developer G on the first developing roller 23*a*1. When the developer G on the first developing roller 23*a*1 reaches the area (i.e., a first developing range) facing the photoconductor drum 21, the toner T in the developer G adheres to the latent image on the photoconductor drum 21. Then, the developer on the first developing roller 23*a*1 is, partly or entirely, supplied to the second developing roller 23*a*2 on the downstream side. When the developer G on the second developing roller 23*a*2 reaches the area (i.e., a second developing range) facing the photoconductor drum 21, the toner T in the developer G adheres to the latent image on the photoconductor drum 21. The latent image on the photoconductor drum 21 is developed with the toner T in each of the first and second developing ranges, and thus a high-quality image is formed.

The developing device 23 employs premix developing, and fresh developer G (toner T and carrier GC) is supplied from the developer container 28 via the developer supply device 80, and degraded developer G (i.e., carrier GC mainly) is discharged through a discharge passage 70 to the waste toner container outside the developing device 23.

Referring to FIG. 2, the developer container 28 contains developer G (toner T and carrier GC) supplied to the developing device 23. The developer container 28 supplies fresh toner T and fresh carrier GC to the developing device 23. Specifically, in one embodiment, according to the percentage of toner T in developer G (or toner density) detected by a magnetic sensor of the developing device 23, a conveying screw 82 of the developer supply device 80 is driven, thereby transporting the developer G from a reservoir 81 to a downward passage 85. Then, the developer G falls though the downward passage 85 to the developing device 23.

Next, a configuration and operation of the developing device 23 is described in further detail below.

With reference to FIG. 3, the developing device 23 includes two developer bearers, namely, the first and second developing rollers 23*a*1 and 23*a*2; three developer conveyors, namely, conveying screws 23*b*1, 23*b*2, and 23*b*3; and the doctor blade 23*c* serving as a developer regulator. The developer conveyors are not limited to screws but include augers, coils, and paddles. A casing 23*k* (in FIG. 3) and an interior of the developing device 23 together define three conveyance compartments B1, B2, and B3 (i.e., a supply compartment, a collection compartment, and a stirring compartment).

The two developing rollers (the first and second developing rollers 23*a*1 and 23*a*2) are disposed facing the photoconductor drum 21 and arranged around a circumference of the photoconductor drum 21. Each of the first and second developing rollers 23*a*1 and 23*a*2 includes a cylindrical sleeve made of a nonmagnetic material and is rotated clockwise in FIG. 2 by a driving unit. The nonmagnetic material includes, but not limited to, aluminum, brass, stainless steel, and conductive resin. Magnets secured inside the sleeves of the first and second developing rollers 23*a*1 and 23*a*2 generate magnetic fields to cause the developer G to stand on end on the circumferential surfaces of the sleeves. Along magnetic force lines arising from the magnets in a normal direction, the carrier GC in the developer G stands on end, in a chain shape. The toner T adheres to the carrier GC standing on end in the chain shape, thus forming a magnetic brush. As the sleeve rotates, the magnetic brush is transported in the direction of rotation of the sleeve (clockwise in the drawing).

In the present embodiment, the first developing roller 23*a*1 and the second developing roller 23*a*2 are identical or similar in outer diameter and similar in structure except magnetic pole arrangement of the magnets disposed therein. The first developing roller 23*a*1 and the second developing roller 23*a*2 rotate at identical rotation speed.

In the present embodiment, the surface of the sleeve of each of the first and second developing rollers 23*a*1 and 23*a*2 is processed with magnetic blast or sandblasting. Accordingly, the amount of runout of the first and second developing rollers 23*a*1 and 23*a*2 is relatively large.

The doctor blade 23*c* serving as the developer regulator faces the first developing roller 23*a*1 on the upstream side in the direction of rotation of the photoconductor drum 21 to adjust the amount of developer G on the first developing roller 23*a*1.

Each of the conveying screws 23*b*1 through 23*b*3 includes a shaft and a spiral blade provided to the shaft and stirs developer contained in the developing device 23 while circulating the developer in the longitudinal direction thereof (hereinafter "developer conveyance direction"), which is perpendicular to the surface of the paper on which FIG. 3 is drawn and identical to the axial direction of the first and second developing rollers 23*a*1 and 23*a*2.

Specifically, inner walls of the developing device 23 partly separate the conveyance compartment B1, in which the conveying screw 23*b*1 transports developer, the conveyance compartment B2, in which the conveying screw 23*b*2 transports developer, and the conveyance compartment B3, in which the conveying screw 23*b*3 transports developer, from each other. The downstream side of the conveyance compartment B2 communicates with the upstream side of the conveyance compartment B3 via a first communicating portion. The downstream side of the conveyance compartment B3 communicates with the upstream side of the conveyance compartment B1 via a second communicating portion. The downstream side of the conveyance compartment B1 communicates with the upstream side of the conveyance compartment B3 via a downward channel. The conveying screws 23*b*1 through 23*b*3 circulate developer in the longitudinal direction through a circulation channel thus defined.

An outlet 23*d* (illustrated in FIG. 2) is in the wall defining the conveyance compartment B3 to discharge a part of the developer G contained in the developing device 23 to the discharge passage 70. Specifically, as the developer supply device 80 supplies the developing device 23 with the developer G, the level (i.e., an upper face) of developer G therein rises. When the level of developer G exceeds a threshold, excessive developer is discharged through the outlet 23*d* to the discharge passage 70. Thus, degraded carrier GC contaminated with resin base or additives of toner T is automatically discharged from the developing device 23. Accordingly, degradation of image quality over time is inhibited.

Since the developing device 23 according to the present embodiment employs premix developing, apparent speed of degradation of carrier is retarded, and replacement cycle of developer is elongated.

It is to be noted that, referring to FIG. 2, the developer container 28 in the present embodiment is substantially box-shaped and includes a shutter to open and close an outlet, a conveying screw 285, and an agitator 286.

Users manually install the developer container 28 in and removed from the developer supply device 80 (or the image forming apparatus 1) in a horizontal or substantially horizontal direction. The outlet of the developer container 28 opens downward in the bottom of the developer container 28 to discharge developer from the developer container 28 to the reservoir 81 of the developer supply device 80. The shutter of the developer container 28 moves in the direction in which the developer supply device 80 is installed in and removed from the developer supply device 80 to open and close the outlet.

Distinctive features of the developing device 23 according to the present embodiment are described below.

In the present embodiment, the first and second developing rollers 23*a*1 and 23*a*2 are disposed adjacent to each other in direction of rotation (around the circumference) of the photoconductor drum 21, and the difference in runout amount therebetween is restricted to a predetermined amount (10 μm in the present embodiment) or smaller. In other words, a combination of the first and second developing rollers 23*a*1 and 23*a*2 is determined so that an absolute value of X1-X2 is 10 μm or smaller when X1 represents the runout amount of the first developing roller 23*a*1 and X2 represents the runout amount of the second developing roller 23*a*2.

Figures 5A, 5B, 6:
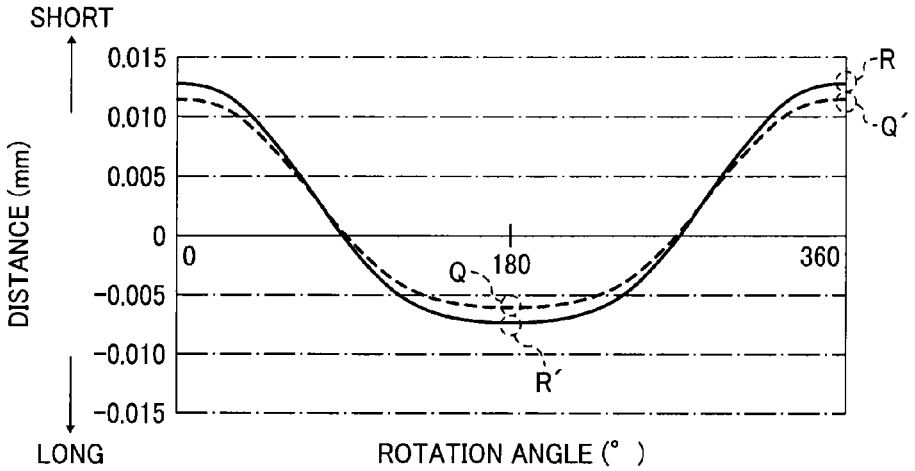
FIG. 5A is a table illustrating the relation between the amount of runout of the developing roller and marking color according to an embodiment.
FIG. 5B is a table illustrating the combination of two developing rollers given markings according to an embodiment.
FIG. 6 is a graph illustrating changes in distance between the developing roller and the photoconductor drum while the developing roller makes a complete rotation.
Figure 7:
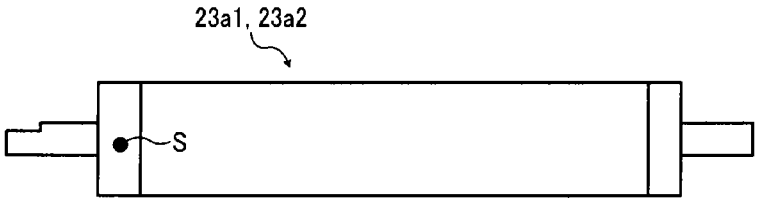
FIG. 7 is a schematic view of the developing roller extending in a rotation axis direction, with a marking according to an embodiment.

For example, referring to FIG. 5A, the first and second developing rollers 23*a*1 and 23*a*2 (also collectively "developing rollers 23*a*") are classified in four groups in accordance with the runout amount, and markings S different in color are given to the classified groups. The marking S is disposed on the surface of an axial end portion of each of the developing rollers 23*a* as illustrated in FIG. 7. As illustrated in FIG. 5B, the combination of the first and second developing rollers 23*a*1 and 23*a*2 is determined according to the marking color to set the difference in runout amount therebetween to 10 μm or smaller.

The term "runout amount" of the developing roller means the difference between the largest and the smallest of the runout. For example, in the case of the runout indicated with a solid line in FIG. 6, the runout amount is 2 μm. The runout amount can be calculated using a method described in JP-2006-17510-A, for example.

It is assumed that, when the first developing roller 23*a*1 (i.e., upstream developing roller) is in the rotation posture illustrated in FIG. 4A, the surface of the first developing roller 23*a*1 is closest to the surface of the photoconductor drum 21, and, at that time, a surface R (hereinafter "most approachable surface R") of the first developing roller 23*a*1 is positioned in the first developing range and opposes a reference surface point M of the photoconductor drum 21. In the present embodiment, the relative positions in the rotation direction of the first and second developing rollers 23*a*1 and 23*a*2 are determined so that, when the reference surface point M of the photoconductor drum 21 that opposes the most approachable surface R is at the position (second developing position) opposing the second developing roller 23*a*2 as illustrated in FIG. 4B, the surface of the second developing roller 23*a*2 withdraws farthest from the photoconductor drum 21.

Specifically, as indicated by the solid line in FIG. 6, due to the runout of the first developing roller 23*a*1, the distance (the development gap) to the first developing roller 23*a*1 from the photoconductor drum 21 varies in accordance with the rotation cycle. When the most approachable surface R is at the first developing position opposing to the photoconductor drum 21, the development gap of the first developing roller 23*a*1 is smallest. When a most withdrawn surface R' is at the first developing position opposing to the photoconductor drum 21, the development gap of the first developing roller 23*a*1 is largest.

Similarly, as indicated by the broken lines in FIG. 6, due to the runout, the distance (the development gap) to the second developing roller 23*a*2 from the photoconductor drum 21 varies in accordance with the rotation cycle. When a most approachable surface Q' is at the second developing position opposing to the photoconductor drum 21, the development gap of the second developing roller 23*a*2 is smallest. When a most withdrawn surface Q is at the second developing position opposing to the photoconductor drum 21, the development gap of the second developing roller 23*a*2 is largest.

Figure 4A:
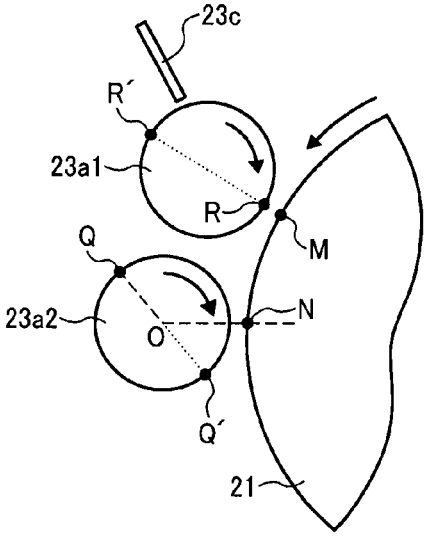
FIGS. 4A and 4B are end-on axial views of developing rollers of the developing device illustrated in FIG. 3, together with a photoconductor drum.
Figure 4B:
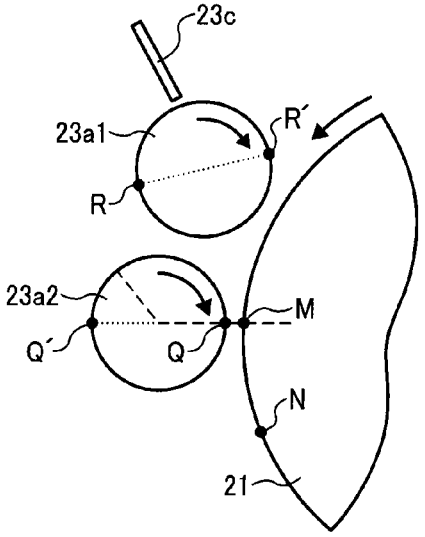

In assembling the developing device 23, the rotation direction postures (phases) of the first and second developing rollers 23*a*1 and 23*a*2 are adjusted such that, when the reference surface point M of the photoconductor drum 21, which has opposed the most approachable surface R of the first developing roller 23*a*1 (being at the first developing position) as illustrated in FIG. 4A, reaches the second developing position as illustrated in FIG. 4B, the most withdrawn surface Q of the second developing roller 23*a*2 opposes the reference surface point M.

For example, in the present embodiment, each of the first and second developing rollers 23*a*1 and 23*a*2 is 30.28 mm in outer diameter, and the photoconductor drum 21 is 100 mm in outer diameter. The arc length from the reference surface point M to the surface point N (hereinafter "arc length MN") on the photoconductor drum 21 in FIGS. 4A and 4B is 24.5 mm, and the first and second developing rollers 23*a*1 and 23*a*2 are 65.66 mm in circumference (distance of one rotation) considering the linear velocity difference with the photoconductor drum 21 at the first and second developing positions. Accordingly, an angle QON formed by a segment QO and a segment ON in the second developing roller 23*a*2 is calculated as QON=360×arc length MN/developing roller circumference (=360×24.5/65.6)=1.34 degrees. The developing device 23 is assembled so that the rotation direction postures (phases) of the first and second developing rollers 23*a*1 and 23*a*2 satisfy the angle QON thus defined. It is to be noted that, in FIG. 4A, reference character O represents the center of the second developing roller 23*a*2 in the direction of diameter.

The above-described relative positions of the first and second developing rollers 23*a*1 and 23*a*2 can inhibit the occurrence of significant image density unevenness in the image on the photoconductor drum 21 even when each of the first and second developing rollers 23*a*1 and 23*a*2 exhibits runout in the multistage developing device 23.

More specifically, the developing process to increase the image density is undesirably repeated if the second developing roller 23*a*2 is closest to the photoconductor drum 21 (the most approachable surface Q' is at the second developing position) when the reference surface point M of the photoconductor drum 21 that has opposed the most approachable surface R of the first developing roller 23*a*1 reaches the second developing position opposing the second developing roller 23*a*2. The image developed at that time is excessively high in image density.

By contrast, the developing process to reduce the image density is undesirably repeated if the most withdrawn surface Q of the second developing roller 23*a*2 is at the second developing position when the reference surface point of the photoconductor drum 21 that has opposed, at the first developing position, the most withdrawn surface R' of the first developing roller 23*a*1 reaches the second developing position opposing the second developing roller 23*a*2. The image developed at that time is excessively low in image density. Such developing process is executed synchronously with the rotation cycle of the first and second developing rollers 23*a*1 and 23*a*2, and accordingly the image density difference is increased.

By contrast, in the present embodiment, with the above-described relative positions, when a dense image is produced at the first developing position, a light image is produced at the second developing position. When a light image is produced at the first developing position, a dense image is produced at the second developing position. Thus, the excess and shortage of image density are offset, and the image density is balanced in the rotation cycles. That is, even when each of the first and second developing rollers 23*a*1 and 23*a*2 exhibits runout differently, the sum of the image density at the first developing position and the image density at the second developing position is constant, thereby suppressing uneven image density.

Referring to FIG. 7, in the present embodiment, each of the first and second developing rollers 23*a*1 and 23*a*2 has the marking S. The marking S is given to the most approachable surface (R and Q') that approaches closest the photoconductor drum 21. The marking S is disposed in the axial end portion of each of the first and second developing rollers 23*a*1 and 23*a*2, and the location of the marking S is sifted in the axial direction and identical in the rotation direction relative to the axial center portion where the runout is greater.

Figure 8:
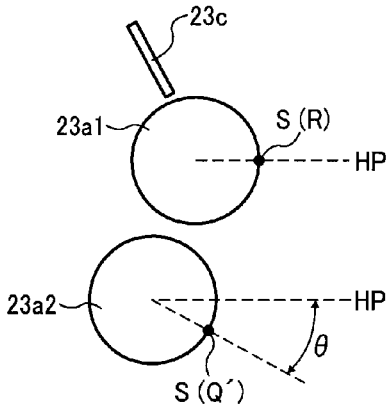
FIG. 8 is a schematic view of relative positions of two developing rollers in the rotation direction with reference to the marking illustrated in FIG. 7.

The marking S of the first developing roller 23*a*1 is shifted by a predetermined angle from the marking S of the second developing roller 23*a*2 to keep the proper relative positions in the rotation direction in assembling the developing device 23. Referring to FIG. 8, in assembling the developing device 23, the position of the first developing roller 23*a*1 in the rotation direction is determined so that the marking S (given to the position corresponding to the most approachable surface R) of the first developing roller 23*a*1 is aligned with the photoconductor drum 21 in the horizontal direction (along a horizontal plane HP in FIG. 8). Subsequently, the position of the second developing roller 23*a*2 in the rotation direction is determined so that the marking S (given to the position corresponding to the most approachable surface Q') of the second developing roller 23*a*2 is at an angle θ (19+/−5° in the present embodiment) downstream in the clockwise direction from the horizontal plane HP extending to the photoconductor drum 21. In practice, the relative positions of the first and second developing rollers 23*a*1 and 23*a*2 in the rotation direction are adjusted to adjust meshing positions of gears attached to the shafts of the first and second developing rollers 23*a*1 and 23*a*2 and an idler gear interposed between the gears. Thus, the first and second developing rollers 23*a*1 and 23*a*2 are disposed with a higher degree of positional accuracy in the rotation direction.

It is to be noted that, although, the marking S is disposed at the most approachable surface (R and Q') of the first and second developing rollers 23*a*1 and 23*a*2 in FIG. 8, alternatively, the marking S may be disposed at the most withdrawn surface (R' and Q) that withdraws farthest from the photoconductor drum 21 at the developing position. Yet alternatively, one of the first and second developing rollers 23*a*1 and 23*a*2 may have the marking S disposed at the most approachable surface while the other of the first and second developing rollers 23*a*1 and 23*a*2 has the marking S disposed at the most withdrawn surface. Such a configuration attains effects similar to those described above.

As described above with reference to FIGS. 5A and 5B, in the present embodiment, the difference in runout amount between the first and second developing rollers 23*a*1 and 23*a*2 is 10 μm or smaller. Even in the configuration in which the relative positions of the first and second developing rollers 23*a*1 and 23*a*2 in the rotation direction are adjusted similar to the present embodiment, the effect to offset the excess and shortage of the image density is degraded if the difference in runout amount between the first and second developing rollers 23*a*1 and 23*a*2 is too large. When a dense image is produced in one of the two developing ranges, it is necessary to produce, in the other developing range, an image whose image density is sufficiently low to cancel the excess image density of the dense image. If the image density of the image produced in the other developing range is too low to cancel the excess image density of the dense image, the uneven image density is not resolved as a whole.

Figure 9:
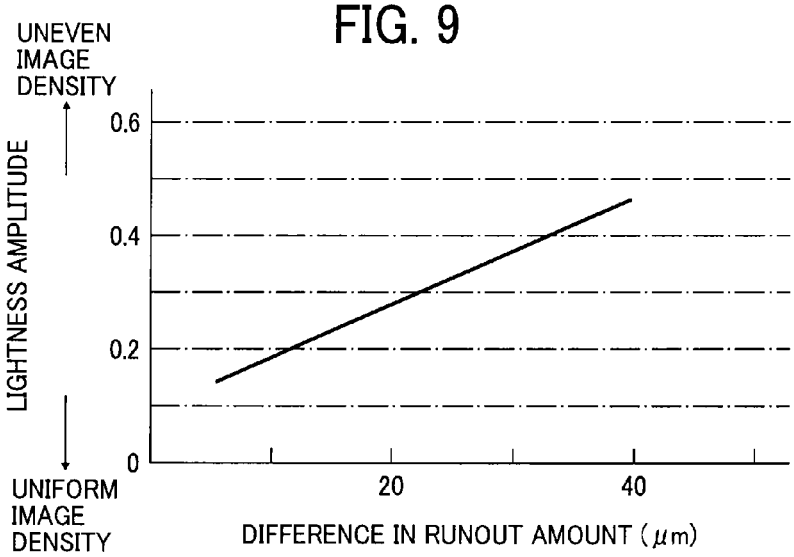
FIG. 9 is a graph illustrating the relation between the difference in runout amount between two developing rollers and a lightness amplitude, which is an index of uneven image density.

FIG. 9 is a graph illustrating a relation between the runout amount difference of the first and second developing rollers 23*a*1 and 23*a*2 and a lightness amplitude, which is an index of uneven image density, based on results of an experiment. According to the results illustrated in FIG. 9, the uneven image density is suppressed to an imperceptible level by limiting the difference in runout amount between the first and second developing rollers 23*a*1 and 23*a*2 to or smaller than 10 μm.

Figure 10:
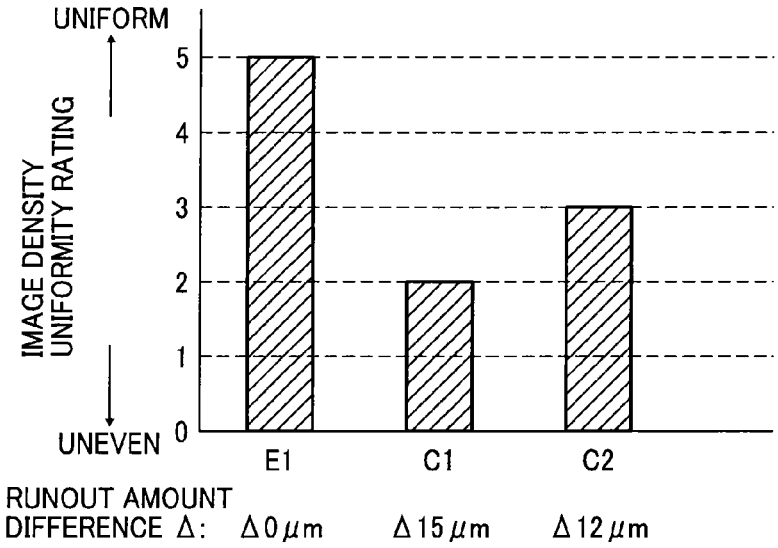
FIG. 10 is a graph illustrating the relation between the difference in runout amount between two developing rollers and image density uniformity rating.

FIG. 10 is a graph illustrating a relation between the runout amount difference of the first and second developing rollers 23*a*1 and 23*a*2 and image density uniformity rating, based on an experiment using the developing device 23 according to the present embodiment to output images.

In Embodiment 1 (E1 in FIG. 10), the runout of the first developing roller 23*a*1 is 20 μm, and the runout of the second developing roller 23*a*2 is 20 μm. In Comparative example 1 (C1 in FIG. 10), the runout of the first developing roller 23*a*1 is 20 μm, and the runout of the second developing roller 23*a*2 is 5 μm. In Comparative example 2 (C2 in FIG. 10), the runout of the first developing roller 23*a*1 is 8 μm, and the runout of the second developing roller 23*a*2 is 20 μm. In the experiment, halftone images having a dot image area ratio of 75% were output using the developing device 23K. The amount of developer scooped by the first developing roller 23*a*1 was 31 mg/cm$^2$.

Also from the result illustrated in FIG. 10, it is understood that the image density uniformity rating of "5", at which uneven image density is not caused, is attained by setting the difference in runout amount between the first and second developing rollers 23*a*1 and 23*a*2 to a relatively small amount. According to FIG. 10, when the difference in runout amount between the first and second developing rollers 23*a*1 and 23*a*2 is greater than 10 μm, the image density uniformity rating is either "3", at which the uneven image density is somehow acceptable, or "2", at which image density is unacceptably uneven depending on the magnitude of the runout amount difference.

It is to be noted that, in the present embodiment, the relative rotation positions of the first and second developing rollers 23*a*1 and 23*a*2 are set such that, when the surface (reference surface point M) of the photoconductor drum 21 that opposes the most approachable surface R of the first developing roller 23*a*1 is at the second developing position, the surface of the second developing roller 23*a*2 withdraws farthest from the photoconductor drum 21 (the most withdrawn surface Q is at the second developing position).

Figure 12A:
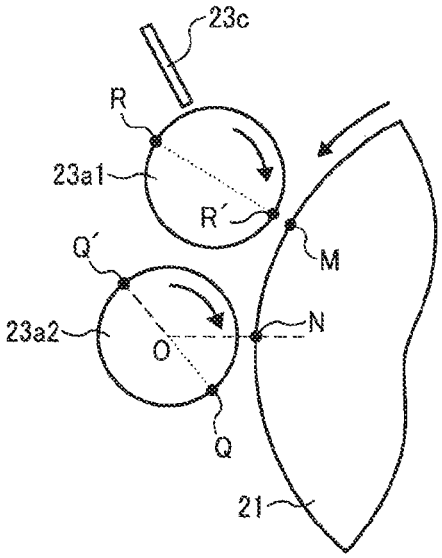
FIGS. 12A and 12B are end-on axial views of developing rollers of the developing device illustrated in FIG. 3, together with a photoconductor drum.
Figure 12B:
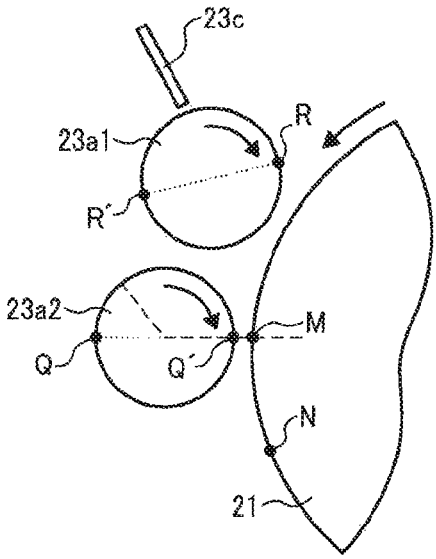

Alternatively, in another configuration as shown in FIGS. 12A and 12B the relative rotation positions of the first and second developing rollers 23*a*1 and 23*a*2 are set as follows. In a state in which a reference surface point of the photoconductor drum 21 opposes the most withdrawn surface R' of the first developing roller 23*a*1 at the first developing position in FIG. 12A, when the reference surface point is at the second developing position, the most approachable surface Q' of the second developing roller 23*a*2 is at the second developing position in FIG. 12B.

As illustrated in FIG. 6, in one rotation of the first and second developing rollers 23*a*1 and 23*a*2, the most approachable surface R is shifted by 180 degrees or approximately 180 degrees from the most withdrawn surface R', and the most withdrawn surface Q is shifted by 180 degrees or approximately 180 degrees from the most approachable surface Q'. Accordingly, such a configuration can attain effects similar to those attained by the configuration described above with reference to FIGS. 4A and 4B.

In other words, the reference surface point M of the photoconductor drum 21 opposes one of the most approachable surface and the most withdrawn surface at the first developing position and the other of the most approachable surface and the most withdrawn surface at the second developing position.

Next, descriptions are given below of a developing device according to a variation with reference to FIG. 11 and Table 1.

The developing device 23 according to the variation is similar to the above-described embodiment in the following features. The runout amount difference of the first and second developing rollers 23*a*1 and 23*a*2 is not greater than the predetermined amount. The relative rotation positions of the first and second developing rollers 23*a*1 and 23*a*2 are set such that, when the reference surface point M of the photoconductor drum 21 to oppose the most approachable surface R of the first developing roller 23*a*1 reaches the second developing range, the most withdrawn surface Q of the second developing roller 23*a*2 is at the second developing position. The surface of the sleeve of each of the first and second developing rollers 23*a*1 and 23*a*2 is processed with magnetic blast or sandblasting to have multiple recesses (recesses and projections) arranged regularly or irregularly in the outer circumferential face.

The recesses in the surfaces of the first and second developing rollers 23*a*1 and 23*a*2 largely affect the amount of developer G scooped onto the first and second developing rollers 23*a*1 and 23*a*2 (or the capability to transport the developer G). Specifically, as the surface roughness of the first and second developing rollers 23*a*1 and 23*a*2 increases, the amount of scooped developer G increases.

Figure 11:
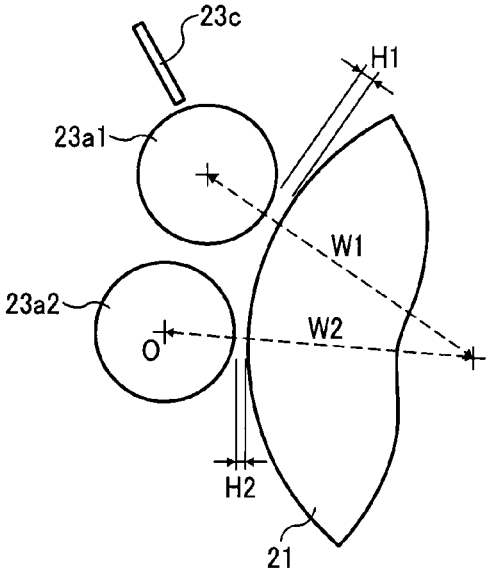
FIG. 11 is an enlarged view illustrating a principal part of a developing device according to a variation.

The variation illustrated in FIG. 11 and Table 1 is different from the above-described in that the first developing roller 23*a*1 (i.e., the upstream developing roller) is greater in surface roughness than the second developing roller 23*a*2 (i.e., the downstream developing roller). Referring to Table 1, the surface roughness (ten-point mean roughness Rz according to Japanese Industrial Standards or JIS) of the first developing roller 23*a*1 is about 70 μm, and the surface roughness of the second developing roller 23*a*2 is about 35 μm.

TABLE 1

| | Ten-point mean roughness Rz (μm) | Runout amount (μm) | Developing gap (μm) |
|---|---|---|---|
| First developing roller | 70 | 25 | 300 |
| Second developing roller | 35 | 10 | 260 |

Differently from the second developing roller 23*a*2, the first developing roller 23*a*1 receives a large stress from the sliding with the developer G at the position (doctor gap) facing the doctor blade 23*c*. Accordingly, the recesses (and projections) in the roller surface tend to disappear (the depth of recesses and height of projections are reduced) over time, and the amount of scooped developer G (or developer transport capability) is likely to decrease. Such degradation in the developer transport capability is alleviated when the surface roughness of the first developing roller 23*a*1 is greater.

Additionally, in the developing device 23 illustrated in FIG. 11, a development gap H1 of the first developing roller 23*a*1 on the upstream side is greater than a development gap H2 of the second developing roller 23*a*2 on the downstream side (H1>H2). For example, as illustrated in Table 1, the development gap H1 of the first developing roller 23*a*1 is about 300 μm, and the development gap H2 of the second developing roller 23*a*2 is about 260 μm.

It is to be noted that the development gap is measured for each of multiple positions on the outer circumferential face of each of the first and second developing rollers 23*a*1 and 23*a*2, which are disposed to sequentially face the photoconductor drum 21, and the average of measurement values is used as the development gaps H1 and H2. In other words, since the first and second developing rollers 23*a*1 and 23*a*2 are identical or similar in outer diameter in the variation, a distance between the axis of the first developing roller 23*a*1 and the axis of the photoconductor drum 21 (hereinafter "inter-axis distance W1") is greater than an inter-axis distance W2 between the axis of the second developing roller 23*a*2 and the axis of the photoconductor drum 21 (W1>W2).

This is because, as described above, the runout amount increases when the surfaces of the first and second developing rollers 23*a*1 and 23*a*2 have the recesses produced by blasting, spraying, or the like. As the first and second developing rollers 23*a*1 and 23*a*2 increase in surface roughness, the runout amount thereof increases. In Table 1, the first developing roller 23*a*1 is about 70 μm in surface roughness and about 25 μm in runout amount. The second developing roller 23*a*2 is about 35 μm in surface roughness and about 10 μm in runout amount.

As the runout amount of the first and second developing rollers 23*a*1 and 23*a*2 increases, the image density becomes more uneven corresponding to the rotation pitch of the first and second developing rollers 23*a*1 and 23*a*2.

Such uneven image density corresponding to the rotation pitch can be suppressed when the first and second developing rollers 23*a*1 and 23*a*2 having similar runout amounts are paired. The first developing roller 23*a*1, however, is greater in surface roughness than the second developing roller 23*a*2, and accordingly the runout amount of the first developing roller 23*a*1 is greater, which increases the possibility of uneven image density corresponding to the rotation pitch.

In view of the foregoing, in this variation, the development gap H1 of the first developing roller 23*a*1 is greater than the development gap H2 of the second developing roller 23*a*2, thereby reducing perception of the uneven image density corresponding to the rotation pitch caused by the runout of the first developing roller 23*a*1. That is, even in the configuration that tends to cause the uneven image density corresponding to the rotation pitch, the unevenness becomes less noticeable as the development gap increases in size. In the variation illustrated in FIG. 11 and Table 1, although the runout of the first developing roller 23*a*1 is larger, the uneven image density corresponding to the rotation pitch is suppressed since the development gap H1 of the first developing roller 23*a*1 is greater. Additionally, since the development gap H2 of the second developing roller 23*a*2 is not large, void of toner occurring at the boundary between a high density portion and a low density portion is not worsened. Accordingly, a preferable image is produced through the multistage developing including developing in the first developing range and the developing in the second developing range.

The inventors have executed an experiment to ascertain the effects of the variation, using the developing device 23 according to the variation, having the characteristics illustrated in Table 1 and Comparative examples 1 and 2. Comparative example 1 is different from the variation in that the development gaps H1 and H2 of the first and second developing rollers 23*a*1 and 23*a*2 are identical and 260 μm.

Comparative example 2 is different from the variation in that the development gap H1 of the first developing roller 23*a*1 is 220 mm, and the development gap H2 of the second developing roller 23*a*2 is 260 μm. In each of the variation and Comparative examples 1 and 2, images having a dot image area ratio of 75% were produced, and the uneven image density corresponding to the rotation pitch was evaluated with eyes.

In the experiment, the uneven image density corresponding to the rotation pitch was not recognized in the variation. However, the uneven image density was noticeable in Comparative example 1 and worsened in Comparative example 2.

As described above, in the above-described embodiment, the runout amount difference of the first and second developing rollers 23*a*1 and 23*a*2 is not greater than the predetermined amount. Additionally, the relative rotation positions of the first and second developing rollers 23*a*1 and 23*a*2 are set such that, when the reference surface point M of the photoconductor drum 21 to oppose the most approachable surface R of the first developing roller 23*a*1 is at the second developing position, the second developing roller 23*a*2 withdraws farthest from the photoconductor drum 21 (the most withdrawn surface Q is at the second developing position).

Adjusting the relative positions as described above can inhibit the occurrence of significant image density unevenness in the image on the photoconductor drum 21 even when each of the multiple developing rollers 23*a* exhibits runout in the multistage developing device 23.

It is to be noted that the descriptions above concern the developing device 23 employing two-component developing and configured to receive the two-component developer G supplied from the developer container 28. However, aspects of this specification are applicable to a developing device employing two-component developing and configured to receive toner supplied from a toner container.

Further, the aspects of this specification are applicable to not only the developing device 23 containing two-component developer but also a developing device containing one-component developer (i.e., toner) and employing contactless one-component developing. In this case, multiple developing rollers are disposed facing the image bearer and at a distance (developing gap) from the image bearer.

Further, the aspects of this specification are applicable to not only the developing device 23 including the two developing rollers 23*a* but also a developing device including three or more developing rollers.

Needless to say, the aspects of this specification are applicable to a developing device including two developing rollers that rotate in the opposite directions. For example, JP-2006-235328-A discloses such a developing device.

In such configurations, effects similar to those described above are also attained.

Additionally, in the description above, the photoconductor drum 21 serving as the image bearer, the charging device 22, the developing device 23, and the cleaning device 25 are united in the process cartridge 20. However, in another embodiment, the photoconductor drum 21, the charging device 22, the developing device 23, and the cleaning device 25 are independently installable in and removable from the image forming apparatus 1. In yet another embodiment, at least two of these components are united into the process cartridge 20 and the rest are independently installable in and removable from the image forming apparatus 1. In such configurations, effects similar to those described above are also attained.

It is to be noted that the term "process cartridge" used in this specification means an integrated unit including an image bearer and at least one of a charging device, a developing device, and a cleaning device united together to be removably installable in the image forming apparatus.

Numerous additional modifications and variations are possible in light of the above teachings. It is therefore to be understood that within the scope of the appended claims, the present disclosure may be practiced otherwise than as specifically described herein. Such variations are not to be regarded as a departure from the scope of the present disclosure and appended claims, and all such modifications are intended to be included within the scope of the present disclosure and appended claims. The number, position, and shape of the components of the image forming apparatus described above are not limited to those described above.

What is claimed is:

1. A developing device to develop a latent image on a rotatable image bearer, the developing device comprising:

an upstream developing roller disposed opposite the image bearer at a first developing position, and a downstream developing roller disposed adjacent to and downstream from the upstream developing roller in a direction of rotation of the image bearer, disposed opposite the image bearer at a second developing position, wherein each of the upstream developing roller and the downstream developing roller has a most approachable surface point that provides a smallest separation gap to the image bearer at a respective one of the first and second developing positions, and has a most withdrawn surface point that provides a greatest separation gap to the image bearer at the respective one of the first and second developing positions, and in a state in which a reference surface point of the image bearer is disposed opposite the most approachable surface point of the upstream developing roller at the first developing position, when the reference surface point reaches the second developing position the reference surface point opposes the most withdrawn surface point of the downstream developing roller.

2. The developing device according to claim 1, wherein a difference in runout amount between the upstream developing roller and the downstream developing roller is not greater than 10 μm.

3. The developing device according to claim 1, wherein the upstream developing roller has a marking disposed at either the most approachable surface point or the most withdrawn surface point thereof, the downstream developing roller has a marking disposed at either the most approachable surface point or the most withdrawn surface point thereof, and the marking of the upstream developing roller is shifted by a predetermined angle from the marking of the downstream developing roller to set relative rotation positions of the upstream developing roller and the downstream developing roller.

4. The developing device according to claim 3, wherein the markings are each color-coded in accordance with a runout amount classification.

5. The developing device according to claim 1, further comprising:

a casing to contain two-component developer including toner and carrier; and a developer regulator disposed facing the upstream developing roller to adjust an amount of the two-component developer on the upstream developing roller, wherein the upstream developing roller and the downstream developing roller have an identical rotation speed and an outer diameter.

6. The developing device according to claim 1, wherein the upstream developing roller has a surface roughness greater than a surface roughness of the downstream developing roller.

7. The developing device according to claim 1, wherein the upstream developing roller is disposed farther from the image bearer than the downstream developing roller.

8. A removably installable process cartridge for an image forming apparatus, the process cartridge comprising:

the image bearer to bear the latent image; and the developing device according to claim 1 to develop the latent image on the image bearer.

9. An image forming apparatus comprising:

the image bearer to bear the latent image; and the developing device according to claim 1 to develop the latent image on the image bearer.

10. A developing device to develop a latent image on a rotatable image bearer, the developing device comprising:

an upstream developing roller disposed opposite the image bearer at a first developing position, and a downstream developing roller disposed adjacent to and downstream from the upstream developing roller in a direction of rotation of the image bearer, disposed opposite the image bearer at a second developing position, wherein each of the upstream developing roller and the downstream developing roller has a most approachable surface point that provides a smallest separation gap to the image bearer at a respective one of the first and second developing positions, and has a most withdrawn surface point that provides a greatest separation gap to the image bearer at the respective one of the first and second developing positions, and in a state in which a reference surface point of the image bearer is disposed opposite the most withdrawn surface point of the upstream developing roller at the first developing position, when the reference surface point reaches the second developing position the reference surface point opposes the most approachable surface point of the downstream developing roller.

11. A removably installable process cartridge for an image forming apparatus, the process cartridge comprising:

the image bearer to bear the latent image; and the developing device according to claim 10 to develop the latent image on the image bearer.

12. An image forming apparatus comprising:

the image bearer to bear the latent image; and the developing device according to claim 10 to develop the latent image on the image bearer.

* * * * *